US006722649B2

(12) United States Patent
Yui

(10) Patent No.: US 6,722,649 B2
(45) Date of Patent: Apr. 20, 2004

(54) CARD PROCESSING APPARATUS

(75) Inventor: Kenichi Yui, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 09/949,637

(22) Filed: Sep. 12, 2001

(65) Prior Publication Data

US 2002/0036374 A1 Mar. 28, 2002

(30) Foreign Application Priority Data

Sep. 28, 2000 (JP) ..... 2000-296172

(51) Int. Cl.[7] ..... B41J 2/32

(52) U.S. Cl. ..... 271/184; 271/225; 271/302; 271/303; 271/902; 347/218; 347/222

(58) Field of Search ..... 271/184, 225, 271/298, 302, 303, 902; 347/222, 218

(56) References Cited

U.S. PATENT DOCUMENTS

| | | | | | |
|---|---|---|---|---|---|
| 3,180,637 | A | * | 4/1965 | Hunt | 347/222 |
| 4,161,312 | A | * | 7/1979 | Eckhardt et al. | 271/3 |
| 4,613,747 | A | * | 9/1986 | McCarthy | 235/480 |
| 5,163,671 | A | * | 11/1992 | Walters | 271/186 |
| 5,266,969 | A | * | 11/1993 | Mochizuki | 346/76 |
| 5,381,209 | A | * | 1/1995 | Binder et al. | 355/27 |
| 5,600,362 | A | * | 2/1997 | Morgavi et al. | 347/218 |
| 5,683,079 | A | * | 11/1997 | Ebrahimi | 271/258.01 |
| 5,703,635 | A | * | 12/1997 | Sasaki et al. | 347/176 |
| 5,806,999 | A | * | 9/1998 | Kobayashi | 400/188 |
| 5,825,392 | A | * | 10/1998 | Mochizuki | 347/197 |
| 5,941,522 | A | | 8/1999 | Hagstrom et al. | |
| 5,959,278 | A | * | 9/1999 | Kobayashi et al. | 235/449 |
| 6,249,303 | B1 | * | 6/2001 | Mochizuki et al. | 347/222 |
| 6,264,296 | B1 | * | 7/2001 | Klinefelter et al. | 347/4 |
| 6,644,655 | B2 | * | 11/2003 | Wurschum | 271/225 |

FOREIGN PATENT DOCUMENTS

| | | | | |
|---|---|---|---|---|
| JP | 2710293 | | 10/1997 | |
| JP | 10-71648 | | 3/1998 | |
| JP | 2001-63893 | * | 3/2001 | 347/222 |

* cited by examiner

*Primary Examiner*—Donald P. Walsh
*Assistant Examiner*—Daniel K Schlak
(74) *Attorney, Agent, or Firm*—James Creighton Wray; Meera P. Narasimhan

(57) ABSTRACT

A card processing apparatus allows for a more compact apparatus that does not cause a reduction in card transporting and printing processing capacity, but improves the freedom of design as an apparatus by establishing a plurality of processing units such as a printer and coating unit in a rational manner. This is attained by a card processing apparatus having a first transport path extended from a card supply unit, a turning unit on said first transport path, a first processing unit to perform the determined process on a card on said first transport path, a second transport path established obliquely to the card transport direction transported through said first transport path based on said turning unit having an angle of 90° or more and less than 180° with regard to the transport path extending from said first processing unit on said first transport path up to said turning unit, a second processing unit to perform the determined process on said card on said second transport path, and a card discharge unit provided at the end of either said first or said second transport paths.

13 Claims, 13 Drawing Sheets

CARD PROCESSING APPARATUS

BACKGROUND OF THE INVENTION

1. Field of the Invention:

This invention relates to a processing apparatus for recording information such as images and characters on a card or other recording medium. More particularly, this invention relates to a card processing apparatus having a technically ingenious arrangement of a plurality of processing means including a printer, thus to make the device compact and improve the efficiency of processing and attain a high degree of freedom of design.

2. Description of the Related Arts

There have been widely used various types of card printers for printing or recording information such as images and characters on a recording card base of plastic to produce a credit card, license card, IC card and so on.

Usually, the recording device of this kind is composed of a card supplying means including a card stacker for storing one or more blank cards, a recording means such as a thermal printer, and a card discharging means for sending out a finished card. Such processing means are generally arranged along one card transport path.

The recording part includes not only a printer, but also a magnetic encoder for magnetically recording information on the card and a coating means for coating a recording surface of the card with a protective film or a hologram film in order to protect the recording surface and to prevent falsification of the card. These components constituting the recording part are placed almost on the straight card transport path.

For example, Japanese patent Tokkai Hei 10-71648 teaches an apparatus for creating the ID card by printing to the card surface the owner's photograph along with their name, the name of their company and the name of the section to which they belong using a thermal printer. This thermal printer apparatus further incorporates a coating apparatus to cover the card surface to prevent discoloration of the printed indicia after printing such data with a hologram film being either a transparent, protective coating film or having a specific pattern, to improve the durability of the card and to prevent falsification of the ID information and the owner's photograph, the plurality of these processing units being established along substantially one card transport path.

Furthermore, the apparatus described includes a magnetic encoder for magnetically recording information to a magnetic layer established on the back surface of the card, located below the thermal transfer printer and in the apparatus is a separate transport path established substantially parallel to the transport established in the printer forming a transport path to transport the card through an inversion section that includes a card turning unit.

Still further, U.S. Pat. No. 5,941,522 discloses a printer apparatus comprising a transport path provided with a smart card encoder unit established obliquely below a print unit to a card transport path provided with a printer unit and a turning unit (called an index table) via the turning unit.

SUMMARY OF THE INVENTION

According to the apparatus as disclosed in Tokkai Hei 10-71648, because a plurality of processing units are established along a single card transport path that is substantially linear to transport the card targeted for processing, the entire apparatus is prevented from becoming compact and it requires at its minimum volume to be long in horizontal length.

Still further, while the overall length of the apparatus has been halved by separating the card transport path into two, namely the upper and the lower portions, it has been impossible to substantially reduce the volume of the apparatus. Efficiency in the processing of the cards, in other words, efficient card transport, was not possible because the card transport distance was lengthened. In other words, the transport path between the paired card inversion means made the distance longer from the card storage unit or the printer to the magnetic encoder.

Although the apparatuses of the past, such as that disclosed in U.S. Pat. No. 5,941,522, do have the functions required by a card printer, it does not have the structure calling for a coating unit to provide an overcoat of protective film or holograms onto the recorded surface to protect the card's recorded surface or to prevent falsification, which plays a very important role in providing added value to the creation of an ID card. Furthermore, because the obliquely arranged card transport path is arranged obliquely in the direction opposite to that of the card transport, this oblique transport path is built into a different casing that is separate from the casing that houses the printer and it was impossible to interlock these casings and to perform the added process to the card which is the recording medium.

Thus, in view of the situations described above, an object of the present invention is to provide a card processing apparatus that allows for a more compact apparatus that does not cause a reduction in card transporting and printing processing capacity, but improves the freedom of design as an apparatus by establishing a plurality of processing units such as a printer and coating unit in a rational manner.

Another object of the present invention is to provide a highly useful card processing apparatus that establishes the card supply unit to store a plurality of recording media and a printer unit to print to the recording media in one casing and that enables the rational incorporation of other processing means such as a card discharge unit and a magnetic encoder into the necessary area occupied by the card supply unit and printer unit, and that further enables the incorporation of a coating unit to overcoat the recording media with protective film or hologram coating into another casing that can be linked to the casing into which the printer unit is built.

To attain the objects described above according to the card processing apparatus of the present invention, there are provided a first transport path from the card supply unit, a turning unit established along said first transport path and a first processing unit to perform the determined process on a card established in said first transport path, a second transport path established based on a point in said turning unit obliquely to the direction of card transport over said first transport path and a second processing unit to perform the determined process on a card in said second transport path, the end of either said first or said second transport paths established with a card discharge unit.

For purposes of simplicity of explanation, said second transport path is established obliquely having an angle of 90° or more and less than 180° with regard to the transport path leading from said first processing unit in said first transport path to said turning unit.

Also, said first processing unit and said second processing unit are built into one casing, or said first processing unit and said second processing unit can be built into independent casings that can be interlocked to each other.

In the explanation here, said card discharge unit is established at the end of said first transport path. As said turning unit faces said second processing unit to send a card, a card processed at said second processing unit is received and then faces said card discharge unit to send the card out. Said card discharge unit can also be arranged at the end of the second transport path so cards processed at said second processing unit can be discharged to said discharge unit in the same direction as the card transport direction facing the second processing unit from said turning unit.

One of either said first processing unit and said second processing unit is a thermal transfer printer and the other is a coating unit for applying a laminate film.

The card processing apparatus of the present invention has a first transport path from the card supply unit, a turning unit established along said first transport path, a second transport path and a third transport path, the end of at least one of said first, said second and said third transport paths is provided with a card discharge unit and first, second and third processing units each established in said first, said second and said third transport paths perform the determined processes on a card.

Here, said second transport path and said third transport path are established obliquely in directions going away from the turning unit which is the base point of reference.

It is possible also for said first processing unit, said second processing unit and said third processing unit to be comprised in one casing or for at least one of said first processing unit, said second processing unit and said third processing unit to be comprised in a separate and independent casing that can be linked to the casing in which the other of said processing units are housed.

For the explanation of the preferred embodiment, at least one of said first processing unit, said second processing unit and said third processing unit is a thermal transfer printer and that each of the said first processing unit, said second processing unit and said third processing unit is a thermal transfer printer, a laminating film coating unit and a magnetic encoder.

DETAILED DESCRIPTION OF THE PREFERRED EMBODIMENTS

The following is a detailed explanation of the preferred embodiment of the present invention based on the figures provided.

According to this invention, the apparatus not only records all types of information to a recording medium, such a card, it is also provided with a coating function to overcoat the card recording surface with a protective film or hologram to protect the card recording surface and to prevent card falsification, and the plurality of transport paths for the units to execute these functions are rationally arranged so as to make the device more compact. Although a plastic card is used as a recording medium in the recording device of the invention as described herein, the recording device can handle various types of recording media to produce credit cards, license cards, ID cards and so forth. Hence, the type, material and shape of the card to be dealt with and the method of recording information on the card are by no means limited in this invention.

Figure 1:
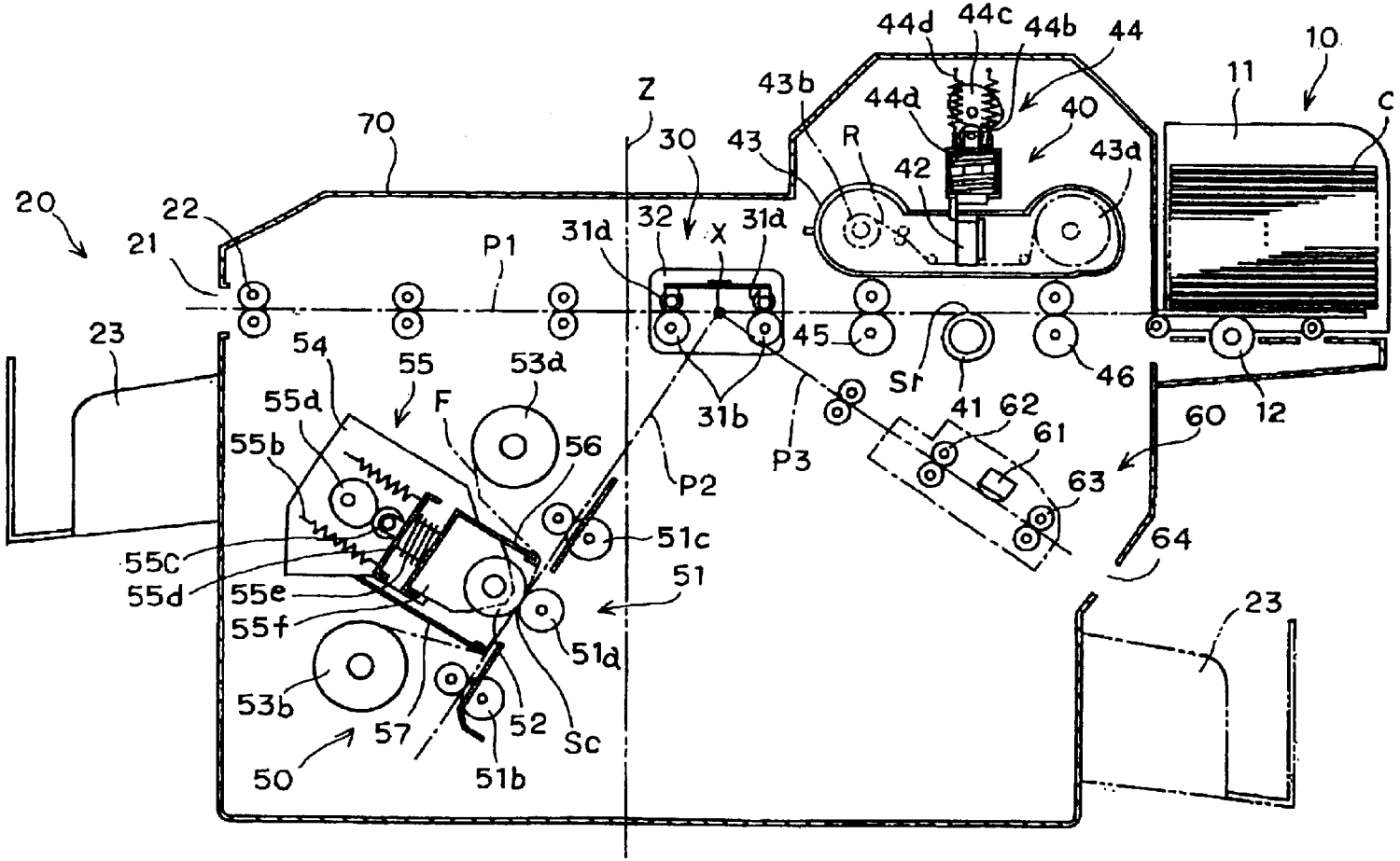
FIG. 1 is a front view schematic drawing of the first embodiment of the processing device in accordance with this invention.

The card processing apparatus, as illustrated in FIG. 1 to indicate the first embodiment of the invention comprises a first transport path p1 from the card supply unit 10 to the card discharge unit 20, a second transport path p2 that intersects said first transport path p1, a third transport path p3 that intersects said first transport path p1, card turning unit 30 established at intersecting point X on said first transport path p1, said second transport path p2 and said third transport path p3, the first processing unit 40 established on said first transport path p1, the second processing unit 50 established on said second transport path p2 and the third processing unit 60 established on said third transport path p3.

Figure 3:
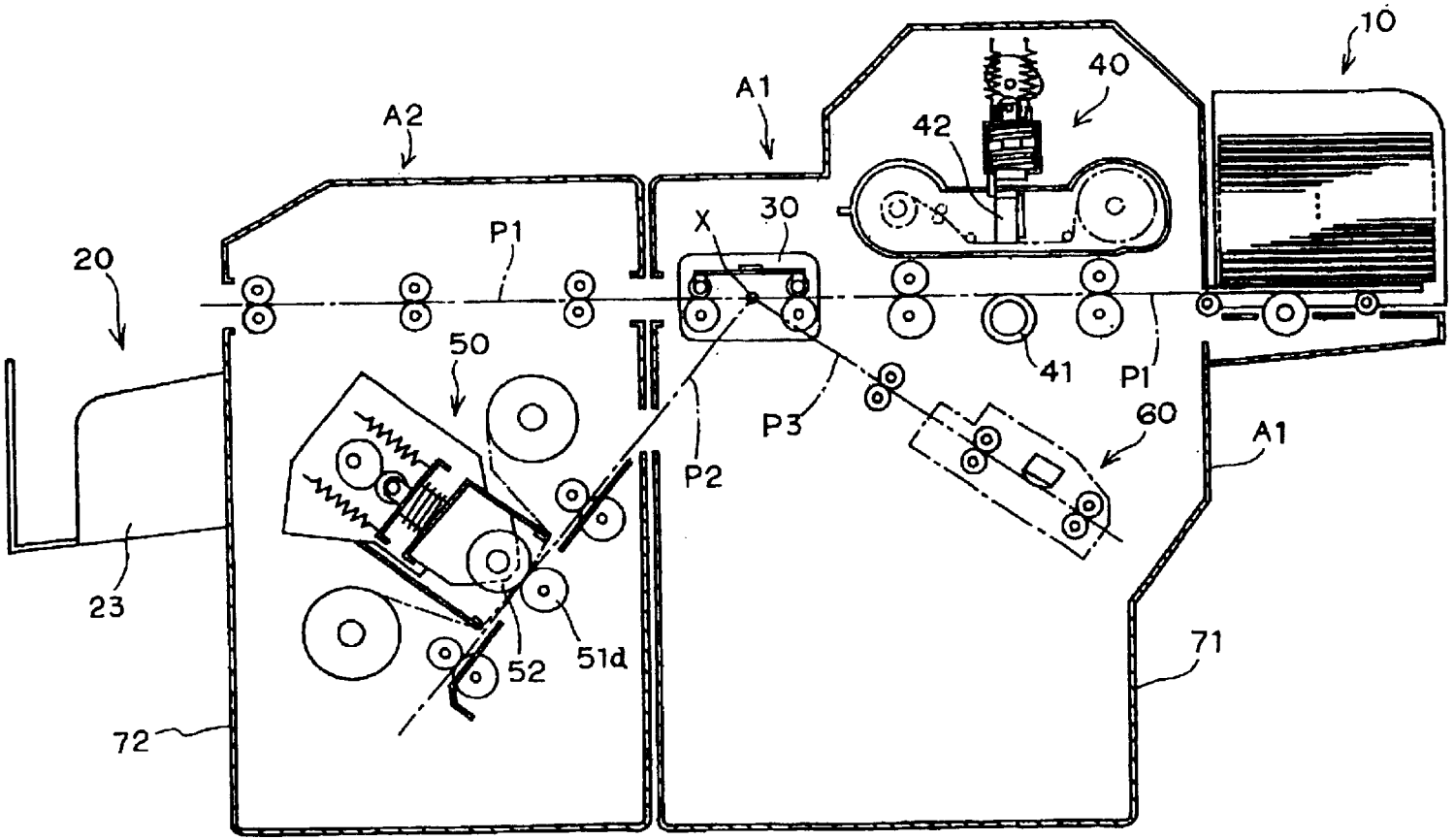
FIG. 3 is a front view schematic drawing of the third embodiment of the processing device in accordance with this invention.

Said first transport path p1 to said third transport path p3, the card turning unit 30, said first processing unit 40, said second processing unit 50 and said third processing unit 60 are incorporated in casing 70 but said casing 70 can be separated along the dotted line Z. FIG. 3 illustrates the third embodiment of the card processing apparatus in which said second processing unit 50 is separated from said first processing unit 40 and said third processing unit 60, each being stored in different casings 71 and 72 of the first apparatus unit A1 and the second apparatus unit A2, the details of which are explained below.

The first embodiment as illustrated in FIG. 1 includes said first processing unit p1 established substantially horizontally in the casing 70, the card supply unit 10 storing more than 1 blank cards C (recording media) and sending said cards one at a time to said first transport path p1, card discharge unit 20 to discharge the card C in said first transport path p1 to an external stacker, the second transport path p2 and the third transport path p3 intersecting said first transport path p1 at the intersecting point X, card turning unit 30 established at the intersecting point X, and the first processing unit 40, second processing unit 50 and third processing unit 60 to process the cards by recording various information to at least one side of the supplied card C and to provide a protective covering to that surface.

Second transport path p2 provided with a second processing unit 50 is arranged obliquely to the transport direction of the card C being transported through first transport path p1 that was sent from the card supply unit 10, based on the point of the card turning unit 30. Furthermore, it is arranged having an angle of 90° or more and less than 180° with regard to the transport path from the first processing unit 40 in the first transport path p1 to the card turning unit 30. Third transport path p3 provided with the third processing unit 60 is arranged obliquely to the transport direction of the card C being transported over first transport path p1 that was sent from the card supply unit 10, based on the point of the card turning unit 30.

The card supply unit 10 comprises a card stacker 11 to stack more than 1 blank cards C one on top of the other, and a kick-roller 12 to send one card at a time from the card stacker 11 by being established to rotate at the bottom of said card stacker 11.

Normally, the card stacker 11 has an open slot to allow the passage of only 1 card to the front position of the first transport path p1. Rotating the kick-roller 12 that is contact with the lowermost card C of the stack of cards sends only the lowermost card to the first transport path p1.

In the preferred embodiment of the present invention, as a process to be performed on the card C which is sent from the card stacker 11, the first processing unit 40 comprises a thermal printer to record by thermally transferring information such as characters or images to one surface of the card C which is the recording medium using a thermal transfer ink.

The first processing unit 40 comprising the thermal transfer printer further comprises a platen roller 41 established at a recording position Sr on the first transport path p1, a thermal head 42 established to allow advancement toward or retraction from said platen roller 41 and an ink cartridge 43 built-in with an ink ribbon R dispensed with thermal transfer ink. Paired transfer rollers 45 and 46 which rotate in synchronization to move the card forward and backward relative to the recording position Sr are established along the first transport path p1.

The ink ribbon R stored in ink cartridge 43 is trained from ribbon supply reel 43*a* to ribbon take-up reel 43*b* through and between the platen roller 41 and the thermal head 42. When thermally transferring information such as characters or images to record them onto the card which is moving along the first transport path p1, the ink ribbon R presses against the surface of the card and while being pressed by the thermal head 42, the heating elements of the thermal head 42 selectively operate to transfer to the card surface the thermal transfer ink ingredient that has been dispensed to the ink ribbon R thereby allowing the writing of the specified information by transferring to the card surface.

The reciprocating motion of the thermal printing head 42 relative to the platen roller 41 is enabled by means of a head reciprocating driver 44 which includes a holder 44*a* for detachably holding the thermal head 42, a follower roller 44*b* fixed to the holder 44*a*, a non-circular cam 44*c* which rotates while coming into contact with the follower roller 44*b*, and a spring 44*d* for pressing the holder 44*a* against the cam 44*c*. The thermal printing head 42 is retained within a detachable head unit held by the holder 44*a* in this embodiment, but the structure of detachably holding the thermal printing head 42 is not specifically limited thereto.

The thermal-transfer recording method and structure of the thermal transfer printer as noted above may be attained by using the technique of a conventional thermal wax-transfer type thermal-transfer printer or thermal-sublimation type thermal-transfer printer. Furthermore, the structure of the reciprocating drive unit to move the thermal head 42 fore and after relative to the platen roller 41 also is not particularly limited the description provided.

The card inversion means 30 located at the intersection point X of the first transport path p1 and the second transport path p2 has the functions of not only transferring the card C from the first transport path p1 to the second transport path p2 and vice versa and to discharge completed cards to the card discharge unit 20, but also turning over the card to print information on both sides of the card at the first processing unit 40.

The card inversion means 30 comprises a pair of pinch rollers 31*a* and 31*b* for holding the card therebetween, and a turning frame 32 that can rotate about the intersection point X of the first and second transport paths p1 and p2.

The pinch rollers 31*a* and 31*b* come in press contact with each other on the first transport path p1 when the turning frame 32 assumes its horizontal posture and on the second transport path p2 when the turning frame 32 is in its vertical posture. One of the pinch rollers is a driving roller so the other is driven by that roller.

One of the pinch rollers 31*a* and 31*b* is a driving roller directly connected to a driving system (not shown) and the other is driven by the driving roller, so that these pinch rollers are rotated in synchronism with the turning frame 32 by the driving system. While the card is pinched between the pinch rollers 31*a* and 31*b*, the turning frame 32 is rotated so the pinch roller also rotates to displace the card. When the turning frame 32 is rotated, the pinch rollers rotate in the opposite direction the same amount of the angle of rotation. It is also possible to drive the turning frame 32 and the pinch rollers 31*a* and 31*b* independently to prevent the sympathetic rotation of the pinch rollers 31*a* and 31*b* when rotating the turning frame 32.

However, in this invention, without limiting to the above-described mechanism, it is acceptable to have any structure for sending the cards between the first transport path and second transport path and functions to rotate and turn the cards.

It is possible to drive the elements of movement using a simple drive control system in the above-described apparatus. While the drive method is not limited, it is possible employ an appropriate motive force transmission means from one motor or a magnetic clutch to control the card supply unit kick-roller 12 and the card turning unit 30 turning frame 32.

The first processing unit 40 reciprocating drive unit 44 cam 44*c* is rotated independently by a head drive source, but it is also possible to use the motive force from a transport drive source if a magnetic clutch is employed.

Though not shown in the drawings, between the card supply unit 10 and the first processing unit 40 there are disposed paired cleaning rollers made of rubber or other material having a moderately sticky surface, and a press roller that straddle the first transport path p1. With this cleaning roller, any other foreign substances possibly adhering to the card sent from the card send from the card supply unit 19 can be removed from the card as it passes therethrough.

The second processing unit 50 established in the second transport path p2 and having the purpose of protecting and preventing falsification of the card's second recorded information recorded by this apparatus is a coating unit to apply an overcoat a coating film F such as a transparent, colored or patterned protective film or hologram. The coating film is over-coated onto the card having information recorded thereupon, at the coating unit, but the function of said turning unit 30 is capable of turning the card C, it is possible to over-coat a coating film to either one or both sides of the card as required.

The coating unit which is the second processing unit 50, thermally transfers the coating film F being fed from the supply roller 53*a* to the take-up roller 53*b* by pressing a heat roller 52 against the recording card C at the coating position Sc. In other words, when the coating film F is being thermally transferred to the card C, the heat roller presses the coating film against the card C while lowering.

The supply roller 53*a* for coating film F and the take-up reel 53*b* are mounted to be established obliquely above and below to nip the coating position Sc.

The rising and lowering means 55 for moving the heat roller 52 fore and aft with regard to the platen roller 51*a* which is positioned at the coating position Sc, as can be seen in FIG. 1, comprises the holder member 55*d* supported by the spring 55*b* swingingly supported with regard to the holder frame 54, a non-circular cam 44*c* established rotatingly drivable to holder frame 54, the follower 55*c* for reciprocatingly swinging holder member 55*d* that follows the rotation of the cam 55*a* and the bracket 55*f* that is interlocked by holder member 55*d* and the resilient member 55*e* to rotatingly hold the heat roller 52.

Rotating the cam 55*a* with the above described rising and lowering means 55, causes the follower 55*c* to resist with the spring 55*b* to move toward the coating position Sc which results in the pressing of the heat roller against the card C through the coating film using the appropriate urging force of the resilient member 55*e*.

Therefore, the desired coating is achieved by taking up the coating film F from the supply roller 53*a* to the take-up roller 53*b* at substantially the same speed as the transfer speed of the card C travelling along the transport path p2 and by transferring the coating film F to the card C by pressing the heat roller against the card C through the coating film F.

The card transport means 51 in the coating unit 50 includes the capstan rollers 51*b* and 51*c* along with the platen roller 51*a* to transport the card C along the second transport path p2 by the similar rotating speed motion of these rollers.

Also, a guide plate 56 and peeling plate 57 are established on the holder frame 54 to keep the coating film in position for coating the coating film being transported from the supply roll 53*a* to the take-up roll 53*b* along the second transport path p2 and to guide the film while it is being transported.

Also, a cleaner is provided for cleaning the card surface in the second transport path p2, however as described above, it is not shown in the drawings. The cleaner here, as with the cleaner established in the first transport path p1 also there are disposed paired cleaning rollers made of rubber or other material having a moderately sticky surface, and a press roller that straddle the second transport path p2 to clean away foreign substances the could adhere to the surface of the card C traveling along the second transport path p2 which is established between the card turning unit 30 and the second processing unit 50.

Also, in the present embodiment of the invention, the third transport path p3 is established below the first processing unit 40. More specifically, the third transport path p3 is formed obliquely below the first processing unit 40 from the intersecting point of the first transport path p1 and the second transport path p2 which is where the third processing unit 60 is established. The third processing unit 60 is a magnetic encoder comprising an information writing head 61 to magnetically record information to a magnetic strip formed on the surface of the card which is similar to what can be seen on the surface of credit cards, etc.

The magnetic encoder which functions here as the third processing unit 60 comprises paired transport rollers 62 which straddle front and back of the head 61 along with the information writing head 61 which is established along the third transport path p3, however this is not to say that the comprising elements or the magnetic recording method is limited to this. Normally, one pass of a card transport or reciprocal and plurality passes to the writing head 61 according to the request for a variety of process such as the initialization of the card's magnetic strip, the magnetic writing or verification of the information are executed, but it is possible to control the transport rollers 62 and 63 to synchronize the transport of the card to each of the processes The information writing head 61 can have a contact type IC writer unit for writing information to IC on the card, if the recording device is an IC card, or it could have a non-contact type antenna instead of an information writing head 61.

The writing process for the various types of information with the third processing unit 60, can be either before or after the card process at the second processing unit 50. Furthermore, there is no limitation herein implied to the order of processes.

The card processing apparatus of the present invention allows for a more compact apparatus compared with apparatuses in which a plurality of processing units are arranged in order along a single path and it improves the freedom of design because the second transport path p2 provided with the second processing unit 50 is established in a direction going away from the first transport path p1 provided with the first processing unit 40 based on the card turning unit established in the first transport path p1 and because the second transport path p2 provided with the second processing unit 50 and the third transport path p3 provided with the third processing unit 60 are established obliquely in directions going away based on the card turning unit 30 established in the first transport path p1.

Furthermore, through the above described transport path structure, compared with the current apparatuses having each of the plurality of processes arranged substantially parallel-above one another, an efficient card transport is achieved because the distance of card travel between a plurality of processes is shorter.

Also, it is clear that the same effect as described is possible with the second processing unit 50 and third processing unit 60 being arranged in different heights with regard to the first processing unit 40.

The card discharge unit 20 in the present embodiment in the drawing is arranged on the other side of the first transport path p1 with regard to the card supply unit 10. The card discharge unit 20, includes the opening 21 formed at the position contacting the first transport path p1 on casing 70, the discharge roller 22 established facing the opening 21 and card receiver 23 on the outer edge of the opening 21, but is not limited to only these. Furthermore, opening 64 is formed at the intersecting point with casing 70 on the extended line of the third transport path p3 so it is possible to discharge cards that experience errors such as a defective process in the apparatus to the outside from the opening 64. Of course, it is possible to form a card discharge unit by establishing a card receiver 23 for the card discharge unit 20 outside of the opening 64.

In the present embodiment providing the first processing unit 40, second processing unit 50 and the third processing unit 60, in order to shorten the processing time required for the consecutive processing of cards, it is preferable to establish a drive source for each that is capable of independently driving each of the first transport path p1, the second transport path p2 and the third transport path p3.

The card turning unit 30 which has a rotating frame 32 to rotate around the intersecting point of the first transport path p1, second transport path p2 and the third transport path p3 hands over the card C between the first processing unit 40 which is established between each of said transport paths p1 to p3 and the second processing unit 50 and the third processing unit 60, or it can face the card discharge unit to forward rotate suitably or rotate when sending cards but, even if the direction of rotation is clockwise, it could also be counter clockwise and is not limited to either in particular.

Next, the explanation shall turn to FIG to describe the second embodiment with the card discharge unit 20 established below the second processing unit 50, or in other words at the end of the second transport path p2.

Figure 2:
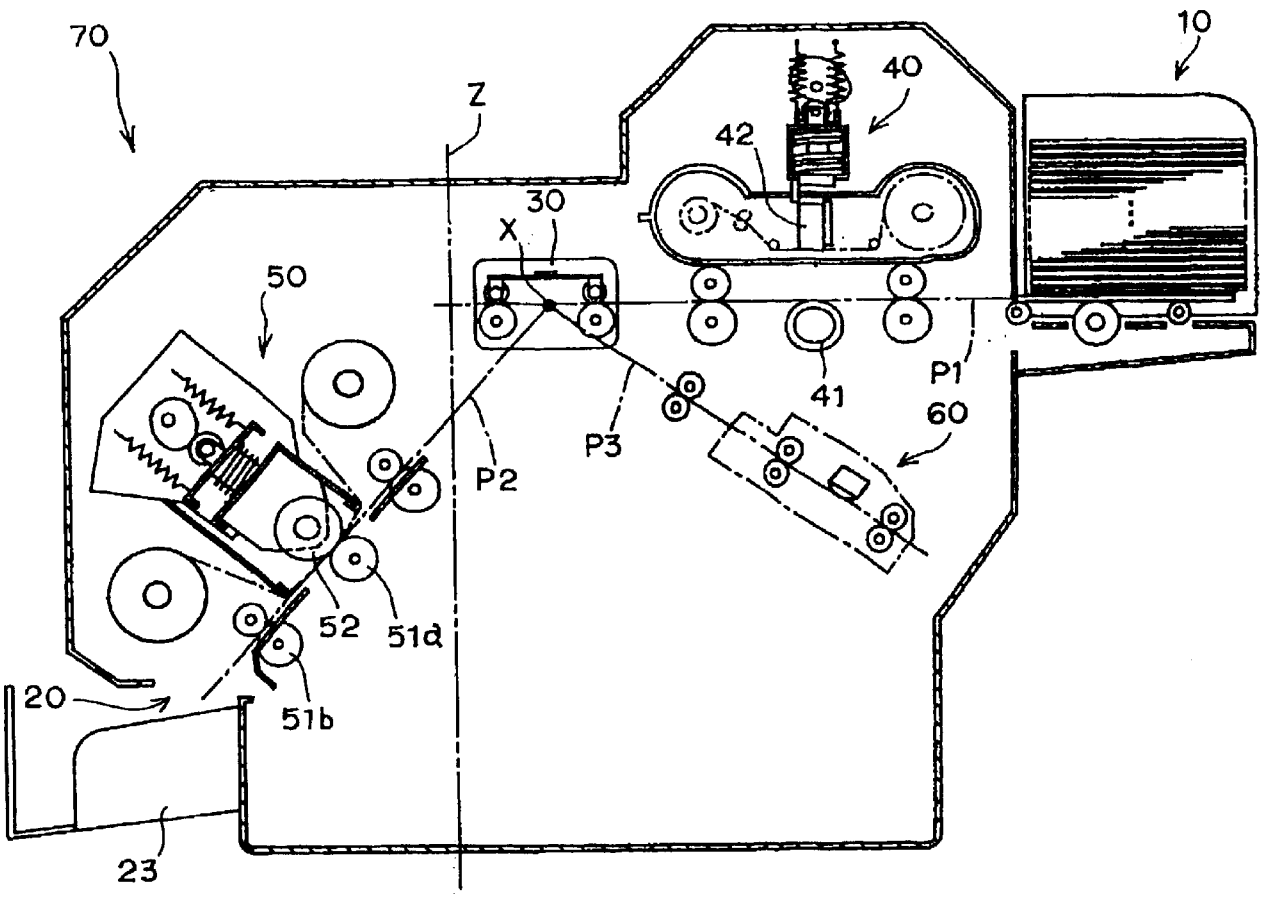
FIG. 2 is a front view schematic drawing of the second embodiment of the processing device in accordance with this invention.

In the second embodiment of the present invention indicated in FIG. 2, the card discharge unit 20 is established at the end of the second transport path p2. In this embodiment, recording is performed from the first processing unit 40 to the third processing unit 60 and at the final second processing unit 50, the card is over-coated with a coating film without having to be returned to the first transport path p1 and is then sent to the discharge unit directly over the second transport path p2 so the distance of card travel in the apparatus is shortened and thus the card transport is made more efficient. In this case, in the present embodiment, the discharge roller 22 that was explained in the first embodiment may overlap the capstan roller 51.

Furthermore, in this embodiment, the first processing unit 40 is used as the printer for convenience and the second processing unit 50 is the coating unit and the third processing unit 60 is the magnetic encoder shown in the figure, although it is not essential that they must be in that corresponding relationship.

In the same way as the first embodiment shown in FIG. 1, an opening, not shown in the figure, is formed at the intersecting point with the casing 70 on the extended line of the third transport path p3 and it is acceptable to discharge cards that have experienced errors, such as improper processing in the apparatus, to the outside from this opening and the card receiver 23 of the card discharge unit 20 can be established outside of this opening to form the card discharge unit.

This embodiment arranges the first to third transport paths p1 to p3 radiating from the rotational axis (intersection point X) of the card turning unit 30, like the embodiment of the previously described FIG. 1, and it has the same or similar elements of the embodiment of FIG. 1, thus a detailed explanation of its structure is omitted.

Next, we shall use FIG. 3 to describe the third embodiment in which the casing 70 for the card processing apparatus in the first embodiment shown in FIG. 1 is separated by the dotted line z and is linkable as the casings 71 and 72.

This embodiment is accomplished by the card supply unit 10, card turning unit 30, the first processing unit 40 and the third processing unit 60 housed in the casing 71 as the first apparatus unit Al and the second processing unit 50 housed in the casing 72 as the second apparatus unit A2 and are linked to form the card processing apparatus.

Thus, the structure calls for the first apparatus unit A1 and the second apparatus unit A2 to each be independently housed in casings 71 and 72 and to be linked as one using any appropriate interlocking means. These casings can be mounted our unmounted as necessary, and these two apparatuses units of A1 and A2 can be incorporated into one casing, so the means for interlocking the casings is not limited.

In this embodiment of the invention, in the same was as the previously described first embodiment, the card turning unit 30 and the first processing unit 40 are provided on the first transport path p1, the second processing unit 50 is provided on the second transport path p3 and the third processing unit p3 is provided on the third transport path p3, and the structure, functions and effects are the same as the first embodiment, so a duplicative explanation shall be omitted. Furthermore, in this embodiment, the first processing unit 40 is used as the printer for convenience and the second processing unit 50 is the coating unit and the third processing unit 60 is the magnetic encoder shown in the figure, although it is not essential that they must be in that corresponding relationship.

In the drawing, the card discharge unit 20 which has the card receiver 23 is established at the end of the first transport path p1 on the second apparatus unit A2, but in the same way as the embodiment described above, but an opening is formed, which is omitted in the drawings, at the intersecting point with the casing 71 on the extended lines on the third transport path p3 so it is possible to discharge to the outside cards that have experienced mis-processing in the apparatus and it is also possible to form a card discharge unit by establishing the card receiver 23 for the card discharge unit 20 on the outside of said opening In this way, because this embodiment calls for a structure with the two apparatus units of A1 and A2, both of these units A1 and A2 can be separated. When using this as an independent card processing unit having the two processing units of 40 and 60 in the first apparatus unit A1 by establishing the card receiver 23 at the end of either the first transport path p1 or the second transport path p2 on the first apparatus unit A1, the second apparatus unit A2 can also be used as an independent card processing apparatus (cleaning apparatus).

Figure 4:
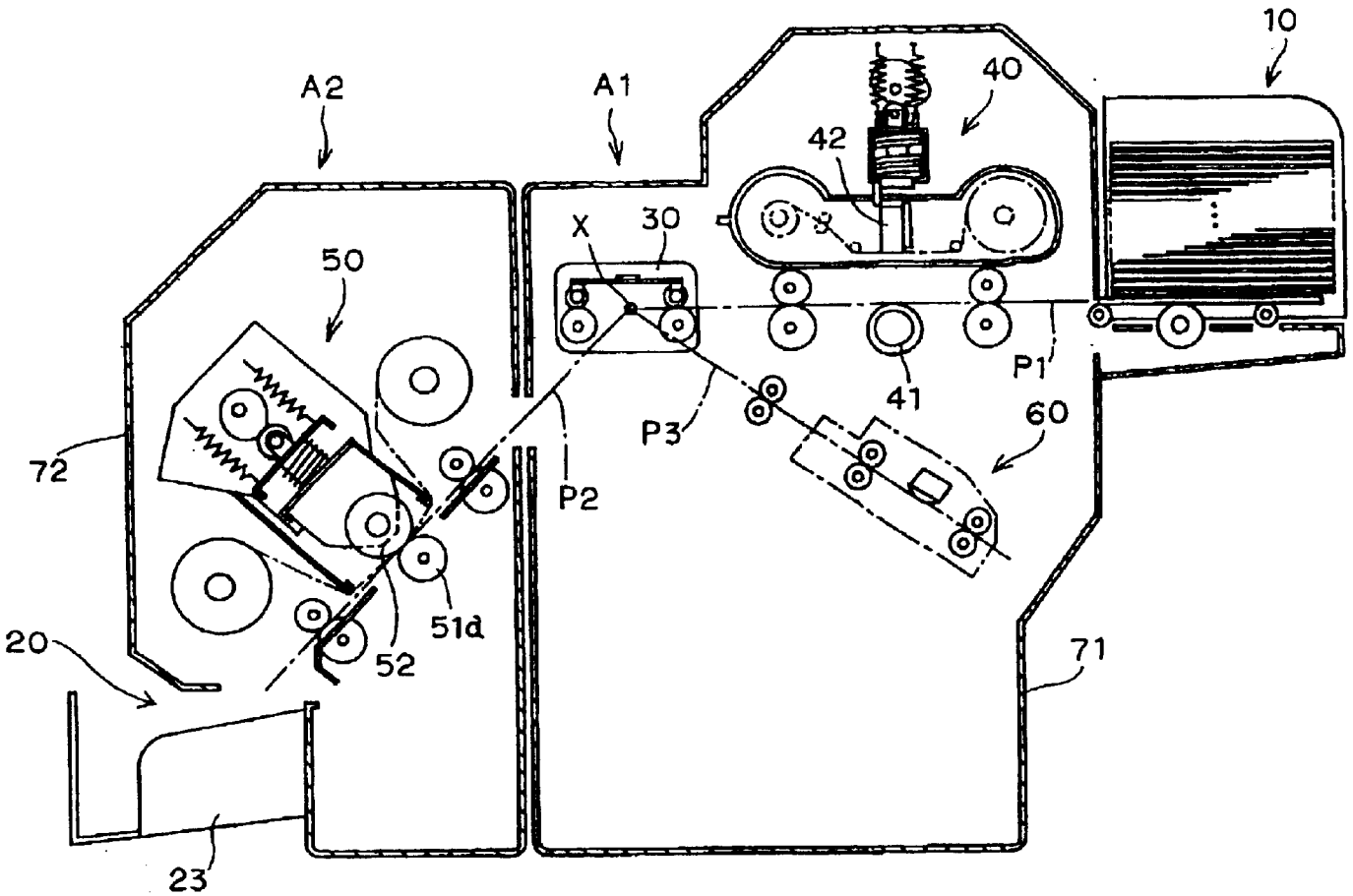
FIG. 4 is a front view schematic drawing of the fourth embodiment of the processing device in accordance with this invention.

FIG. 4 shows the fourth embodiment of this invention in which the casing 70 of the card processing apparatus is separated at the dotted line Z in the second embodiment of this invention which is explained using FIG. 2 and both of these different casings 71 and 72 can be interlocked.

In the same way as the third embodiment this embodiment calls for a card processing apparatus that links the first apparatus unit A1 which stores the card supply unit 10, card turning unit 30 and the first processing unit 40 and third processing unit 60 in the casing 71 and the second apparatus unit A2 which stores the second processing unit 50 in casing 72. In this case, the first apparatus unit A1 and second apparatus unit A2 are each independent and composed by casings 71 and 72 and are linked as one by an appropriate interlocking means. These casings can be mounted or un-mounted as needed to incorporate the two apparatus units of A1 and A2 into one casing so the means for linking the casings is not limited.

Also, in the same way as the second embodiment the card discharge unit 20 is below the second processing unit 50, in other words, because it is established at the end of the second transport path p2, the card that experiences the recording process at the first processing unit 40 and the third processing unit 60 is finally over-coated with a coating film on the recording surface at the second processing unit 50 and is not returned to the first transport path p1, but can be send directly to the discharge unit 20 on the second transport path p2 which shortens the distance of travel of the card in the apparatus thereby allowing for an efficient card transport. In this case as well, the discharge roller 22 explained in the first embodiment overlaps the capstan roller 51*b*.

In this embodiment, for convenience, the drawing shows that the first processing unit 40 is a printer, the second processing unit 50 is a coating unit and the third processing unit 60 is a magnetic encoder, but it is not necessary be limited to these. Also, in the same way as the first embodiment shown in FIG. 1, an opening is formed which is omitted in the drawings at the intersecting point with the casing 71 on the extended lines on the third transport path p3 so it is possible to discharge to the outside cards that have experienced mis-processing in the apparatus and it is also possible to form a card discharge unit by establishing the card receiver 23 for the card discharge unit 20 on the outside of said opening This embodiment also has substantially the same or similar elements of each of the transport paths and processing units in the apparatus of the second embodiment, thus a detailed explanation of its structure is omitted. Also, the two apparatus units of A1 and A2 can be used each as independent units, which is the same as the third embodiment.

An explanation of the operations of the card recording process and the coating process in the card processing apparatus of the invention according to FIG. 5 to FIG. 11 based on the first embodiment of FIG. 1.

Figure 5:
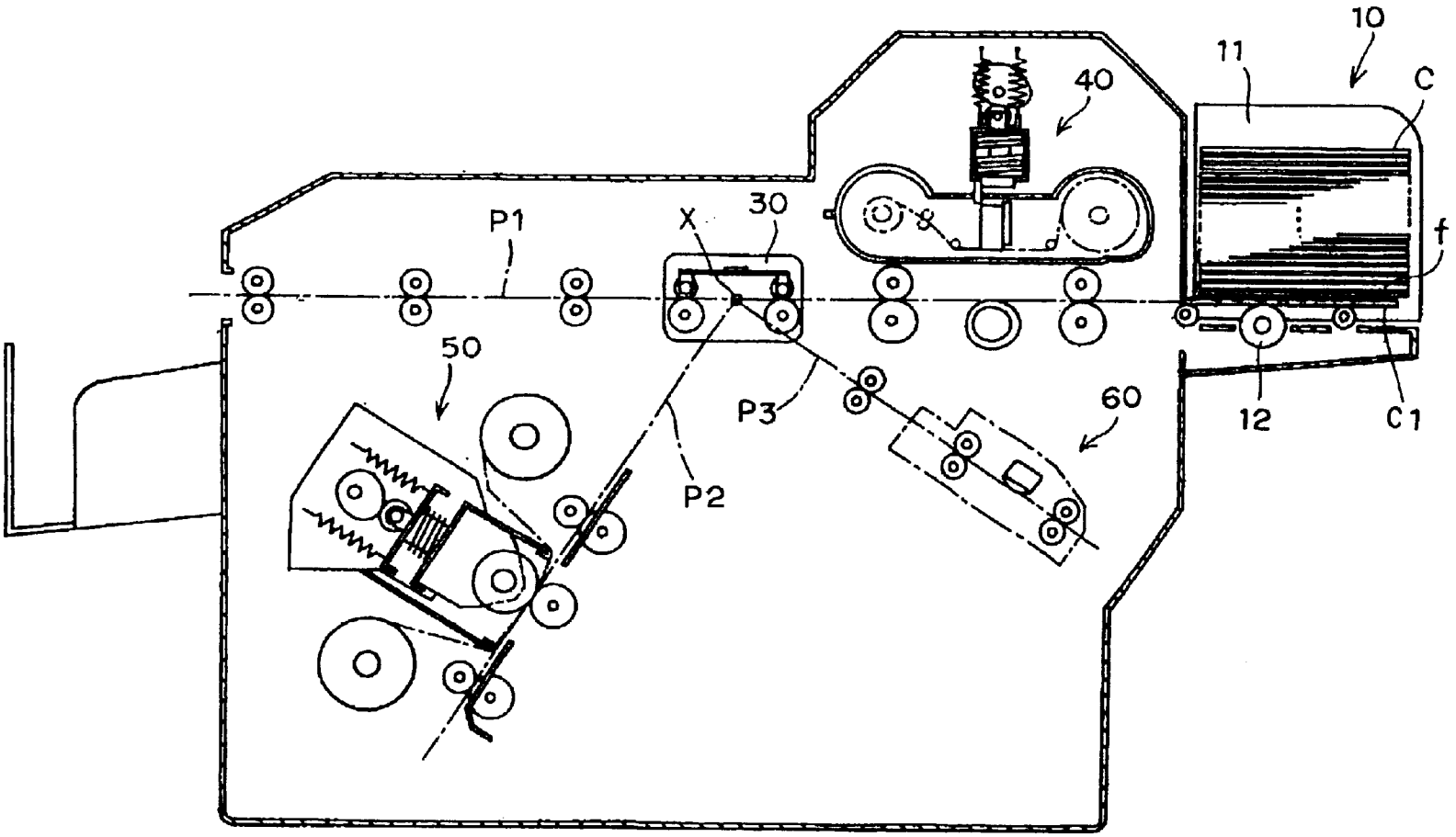
FIG. 5 is a schematic drawing to explain the operations in the card recording and coating process in accordance with the processing apparatus of FIG. 1.

FIG. 5 illustrates the initial state in which a plurality of blank cards C are loaded in the card supply stacker 11 of the card supply unit 10. Upon receiving a card producing command, the device starts to operate by rotating the kick roller 12 of the card supply unit 10, consequently to send out only the lowermost card c1 from the card supply stacker 11 to the first card transport path p1. In the drawings, the surface f (upper face) to be printed with the desired information is symbolically depicted by dots.

Figure 6:
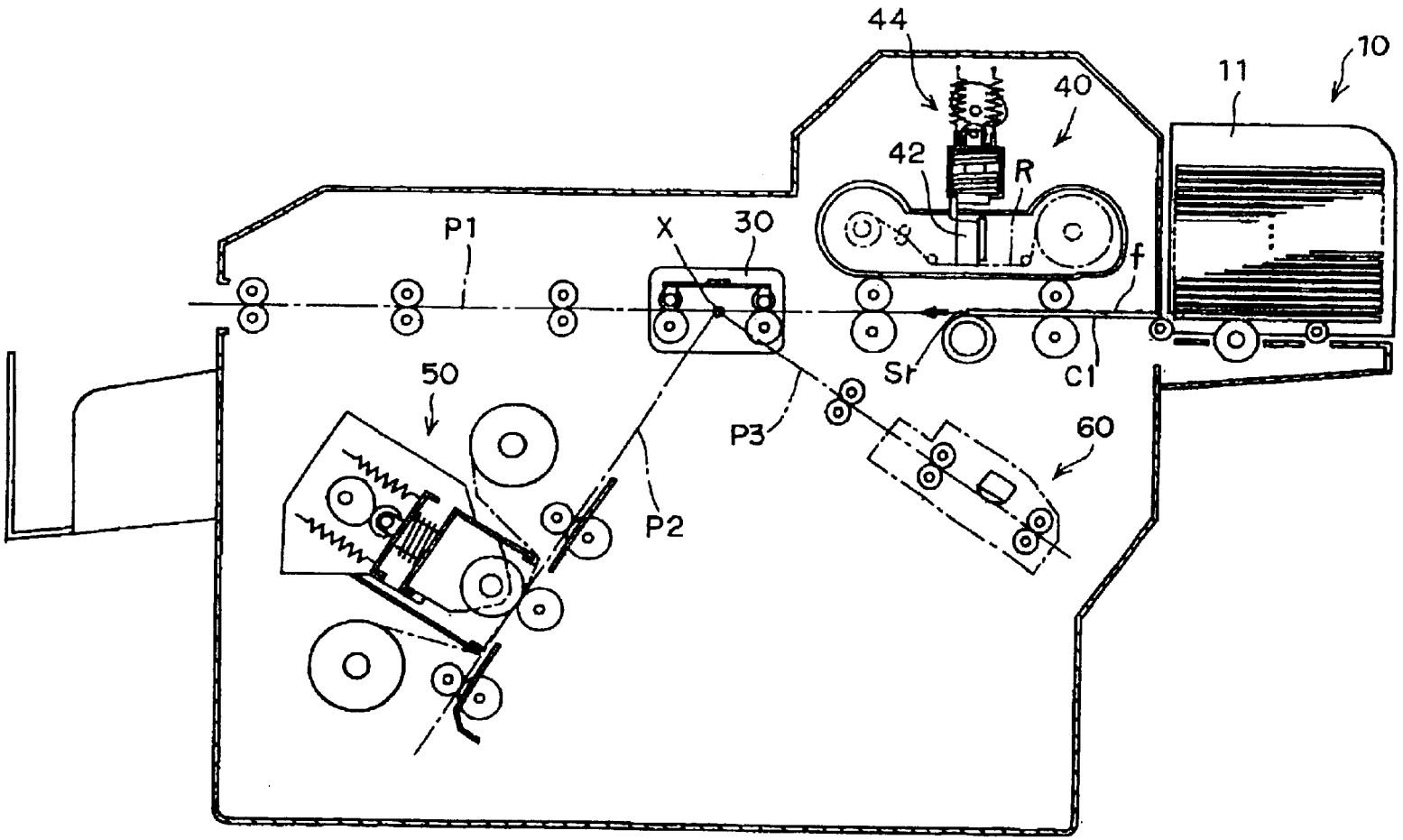
FIG. 6 is also a schematic drawing to explain the operations in the card recording and coating process in accordance with the processing apparatus of FIG. 1.

The card c1 traveling along the first transport path p1 is first transported toward the first processing unit (printer) 40. The feeding to the first processing unit 40 of the card c1 from the card stacker 11 is completed when the card recording start point (the left edge of the card c1 in the drawing) reaches the recording position Sr, as illustrated in FIG. 6.

Next, the process in which information is recorded onto the card is executed. First, the head reciprocal drive unit 44 in the printer 40 operates to move the thermal head 42 toward the card. Through this action, the thermal head 42 presses the ink ribbon R toward the card surface f. In this state, while the card is moving toward the card turning unit 30 (direction of the arrow in FIG. 6), the heating elements on the thermal head 40 are selectively heated to cause the ink ingredient in the ink ribbon to be thermally transferred to the card surface to print the desired image information to the card surface.

Figure 7:
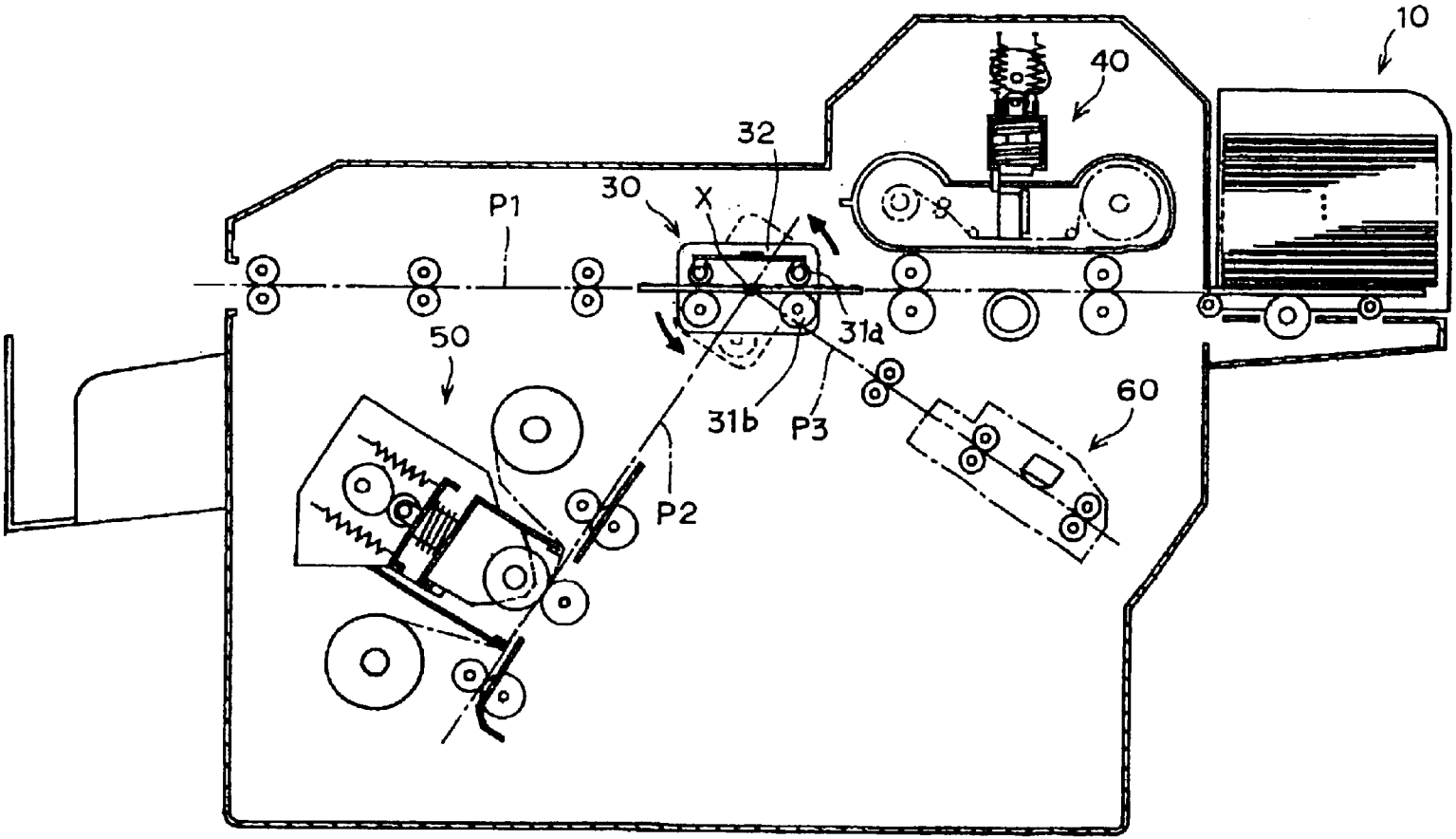
FIG. 7 is also a schematic drawing to explain the operations in the card recording and coating process in accordance with the processing apparatus of FIG. 1.
Figure 8:
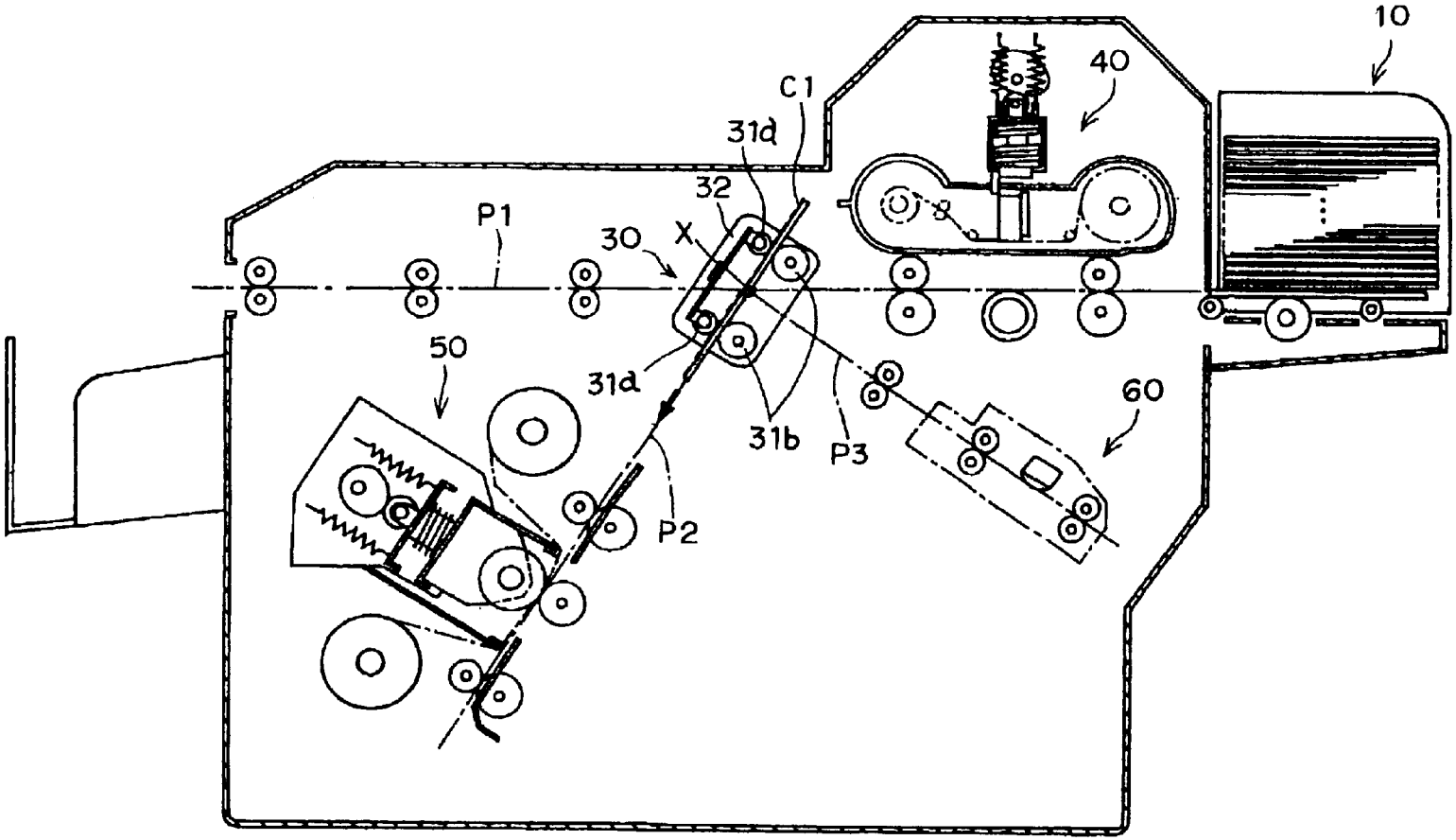
FIG. 8 is also a schematic drawing to explain the operations in the card recording and coating process in accordance with the processing apparatus of FIG. 1.

At the point the recording of information to the card surface is completed, the card is caught by a pair of pinch rollers 31*a* and 31*b* on one end of the card turning unit 30 while in a horizontal state and is then led to the center of the card turning unit 30, as illustrated by the dotted lines in FIG. 7. Thereafter, the card is rotated to the desired position (the direction of the arrow in FIG. 7) in the counterclockwise direction by rotating the card turning unit 30 rotating frame 32 to position the card c1 with the second transport path p2 toward the second processing unit 50 (FIG. 8). In this state, the card c1 is send toward the second processing unit 50 along the second transport path p2 (the direction of the arrow in FIG. 8).

At the second processing unit 50, the coating film F overcoats the surface of the card c1 that has been printed with information at the first processing unit (printer) 40.

Figure 9:
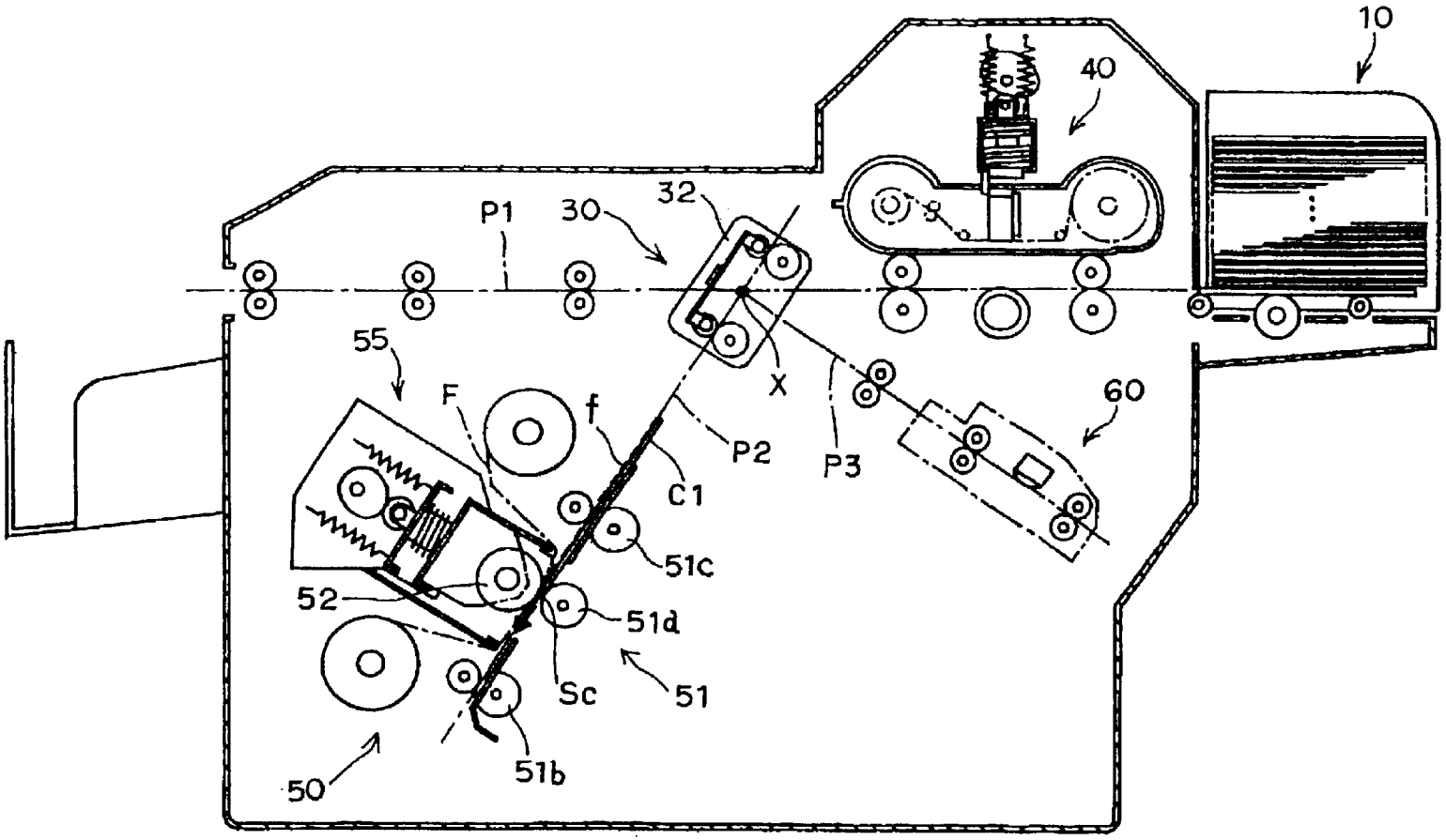
FIG. 9 is also a schematic drawing to explain the operations in the card recording and coating process in accordance with the processing apparatus of FIG. 1.
Figure 10:
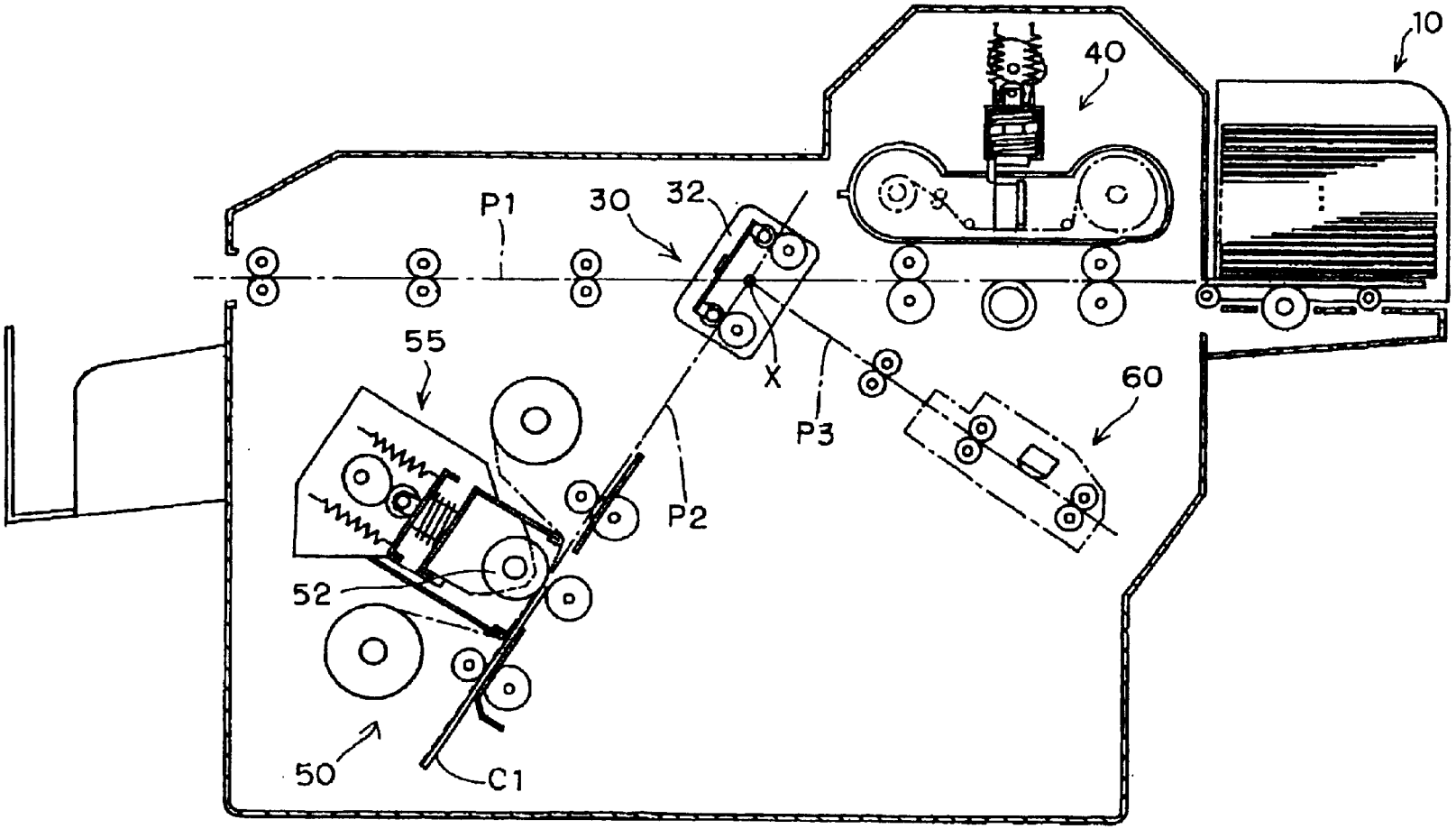
FIG. 10 is also a schematic drawing to explain the operations in the card recording and coating process in accordance with the processing apparatus of FIG. 1.

The feeding of the card c1 from the card turning unit 30 to the second processing unit 50 (coating unit) is completed when the coating surface start point of the card c1 (the lower edge of the card c1 in the drawing) reaches the recording position Sc, as illustrated in FIG. 9.

Next, the film F coating process to the card is executed. First, the coating head 50 rising and lower means 55 operates to move the heat roller 52 toward the card. Through this action, the heat roller 52 presses the coating film F against the card surface f. In this state, while the card is moving away from the card turning unit 30, in other words, as it is moving toward the lower direction (the direction of the arrow in FIG. 9), the heat roller 52 heats to transfer the coating film F to the card surface. This, then, protects the card recording surface with the coating film F.

Figure 11:
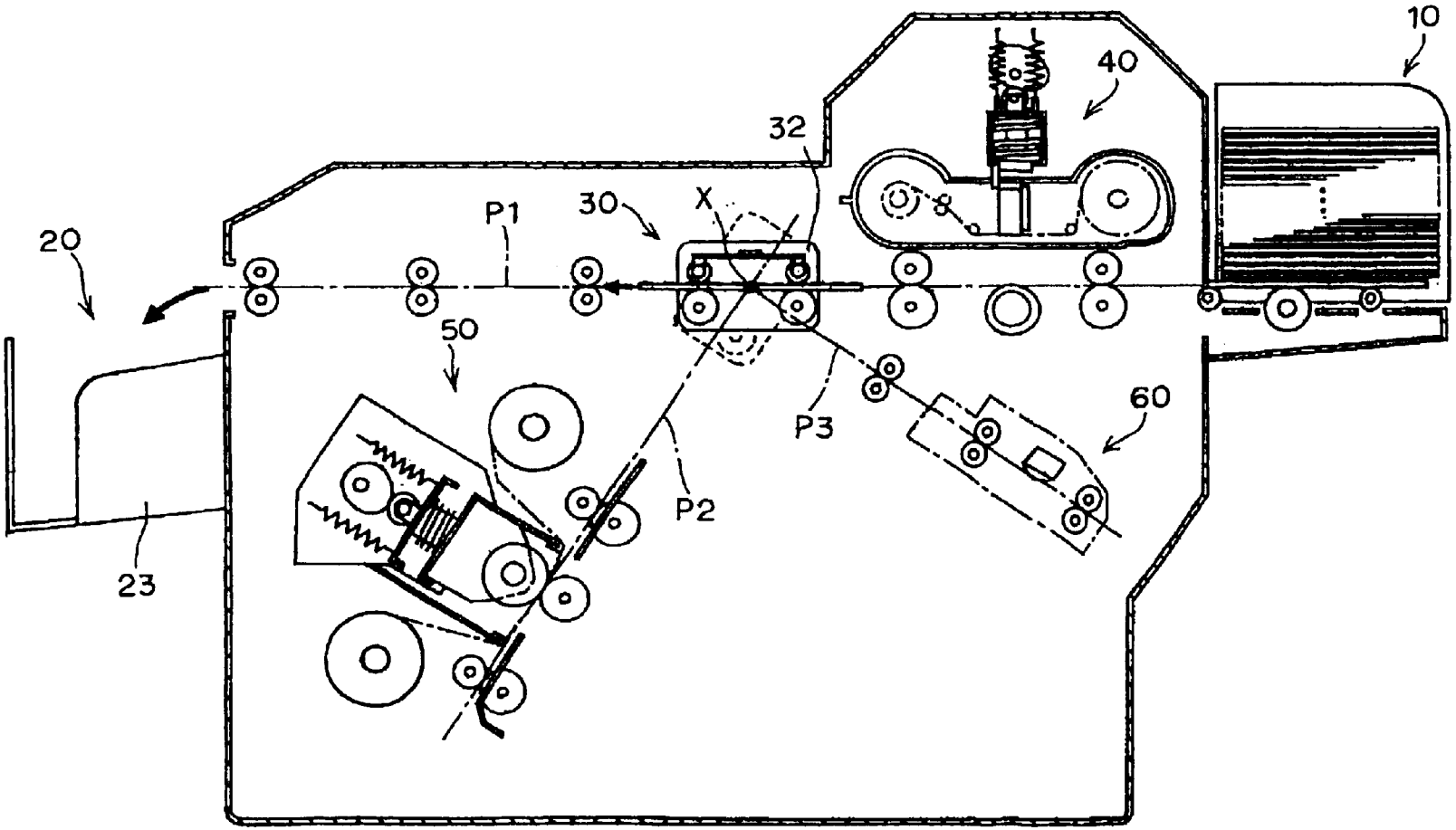
FIG. 11 is also a schematic drawing to explain the operations in the card recording and coating process in accordance with the processing apparatus of FIG. 1.

When the coating process to the card surface is completed (FIG. 10), the coating unit 50 rise and lower means 55 operates to move the heat roller 52 toward the retracting position. Then, the card transport means 51 in the coating unit 50 rotates in the opposite direction to allow the paired pinch rollers 31*a* and 31*b* on one end of the obliquely situated card turning unit 30, as illustrated in FIG. 8, to catch the card c1 to lead it to the center of the card turning unit 30. Thereafter, the card is rotated to the desired position in the clockwise direction by rotating the card turning unit 30 rotating frame 32 to position the card c1 horizontally with the first transport path p1 (FIG. 11). In this state, the card c1 is transported to the discharge unit 20 along the first transport path p1 to be discharged to the card receiver 23 (the direction of the arrow in FIG. 11).

In the process described above, information is recorded and a coating is applied to one side of the card, but to record information to both sides of the card at the printer 40, the card could be inverted 180° at the card turning unit 30 and send again to the printer 40 to record information to both sides of the card.

To coat both sides of the card with the coating film F when information is recorded to both sides of the card, the card from the coating unit in FIG. 11 could be rotated 180°, as described above, and sent again to the coating unit 50 in FIG. 9 to execute the coating process to both sides of the card.

Furthermore, there is no limitation to the above structure in the rotation direction of the card turning unit 30 in the series of process just described, in other words, either direction of rotation or only one direction of rotate are acceptable. For a structure that rotates in only one direction, it is possible to simplify the drive control.

Still further, to magnetically record information to the card C using the third processing unit 60, after the process to record information to the card C at the first processing unit 40, and before the coating process to that card C, or after completing the recording of information to the card C at the first processing unit 40 and the coating process at the second processing unit 50, or, again as an independent process regardless of whether the process to record information at the first processing unit 40 or the coating process at the second processing unit 50, the card C which is transported to and held at the card turning unit 30 can be positioned obliquely at the third transport path p3 to face the third processing unit 60 by rotating the card turning unit 30 rotating frame 32 to any desired angle. In this state, the card C is sent along the third transport path p3 and stopping at the desired location in the third processing unit 60 to perform the desired recording process on the card C.

If the third processing unit 60 is a magnetic encoder, a series of processes are performed to initialize the magnetic strip on the card C with the information writing head established in the magnetic encoder, to write magnetic information and the verify that information, although these are not limited particularly to these structures.

The card C which has completed the information writing process at the third processing unit 60 is sent toward returning to the card turning unit 30 along the third transport path p3 and is held by the card turning unit 30. Thereafter, the card turning unit 30 rotating frame 32 is rotated to the desired angle and the card is positioned obliquely on the second transport path p2 facing the second processing unit 50 (FIG. 8). In this state, the card C is sent along the second transport path p2 to have the desired process performed at the second processing unit 50 (FIG. 9). Subsequent processes are the same as those described above, therefore they will be omitted herewith.

After completing the process to record information to the card at the third processing unit 60, if there are no further processes to be performed on the card C, the card is transported back to the card turning unit 30 and is held there. While being held, the card turning unit 30 rotating frame 32 is rotated to the desired angle to position the card C horizontally with the first transport path p1 (the state represented by the lines in FIG. 11). In this state, the card C is transported to the discharge unit 20 along the first transport path p1 to be discharged to the card receiver 23 (the direction of the arrow in FIG. 11).

Also, the direction of rotation of the card turning unit 30 when recording information to the card C at the third processing unit 60 is not particularly limited thereto.

In the card processing apparatus of the invention just described, the second transport path p2 provided with a second processing unit 50 and the third transport path p3 provided with a third processing unit 60 are arranged obliquely in reference to the card supply unit 10, the card discharge unit 20 and the first transport path p1 which is provided with a first processing unit 40 based on the card turning unit 30, and with the oblique arrangement with each of the above described transport path p2 and transport path p3 being going away based on the card turning unit 30, enable the compact arranged of the structural elements to realize a compact apparatus and convenience.

Furthermore, according to the card apparatus of the present invention, because the card turning unit 30, which has the role of transporting the card between the first transport path p1 and the second transport path p2, it is possible to print or to record information to both surfaces of a card as required, even if the first processing unit 40 (printer) has a function to record information to only one side of a recording medium, because the card turning unit 30 can turn a card over. In the same way, even if the second processing unit (coating unit) 50 has a function to over-coat a film onto only one side of a recording medium, the card turning unit 30 can turn a card over, so if required, the over-coating process can be executed to both sides of the card.

Figure 12:
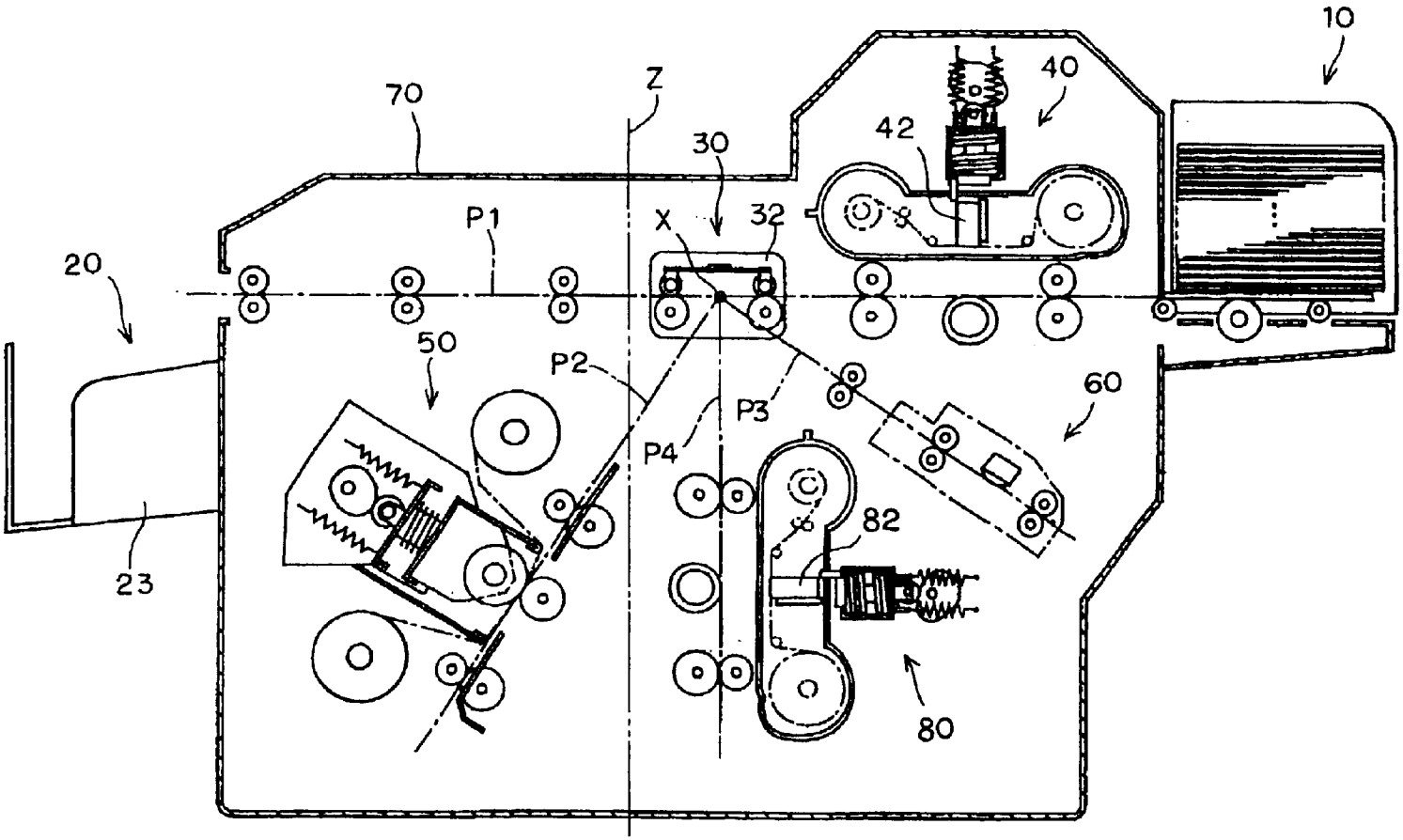
FIG. 12 is a front view schematic drawing o f the fifth embodiment of the processing device in accordance with this invention.

The following explains the fifth embodiment of the card processing apparatus as illustrated in FIG. 12. In this embodiment, the printer of the first processing unit 40 in the first embodiment as illustrated in FIG. 1 or an equivalent printer is added to the fourth processing unit 80 on the fourth transport path p4 arranged directly below the card turning unit 30. The composing elements are substantially the same as the previous embodiment, thus a detailed explanation shall be omitted.

According to this embodiment, it is possible to use a printer having different functions, for example the first processing unit 40 printing binary data information such as characters, for which a thermal wax-transfer type thermal transfer printer is suited and the fourth processing unit 80 printing data having a plurality of gradations such as a photograph, for which a thermal sublimate type printer is suited or it is possible to reverse the arrangement of these. It is also possible for the first processing unit 40 to be a color printer and the fourth processing unit 80 to be a black and white printer, or the opposite arrangement.

It is also possible to separate the casing 70 at the dotted line illustrated in the figure to make a structure that can interlocked as two apparatus units as in the third embodiment illustrated in FIG. 3.

As is clear in this embodiment, according to this invention, a plurality of transport paths intersect commonly through the first transport path p1 and because it is possible to establish the suitable process in each of the transport paths, it is possible to expand the processing units according to the needs and uses of each type of recording card. Therefore, there is no limit to the number of transport paths that could intersect the first transport path in this invention not to the types of processing units established at each of the transport paths. Furthermore, each of the processing units could be built-in to different casings, or one common casing could incorporate a plurality of processing units.

Figure 13:
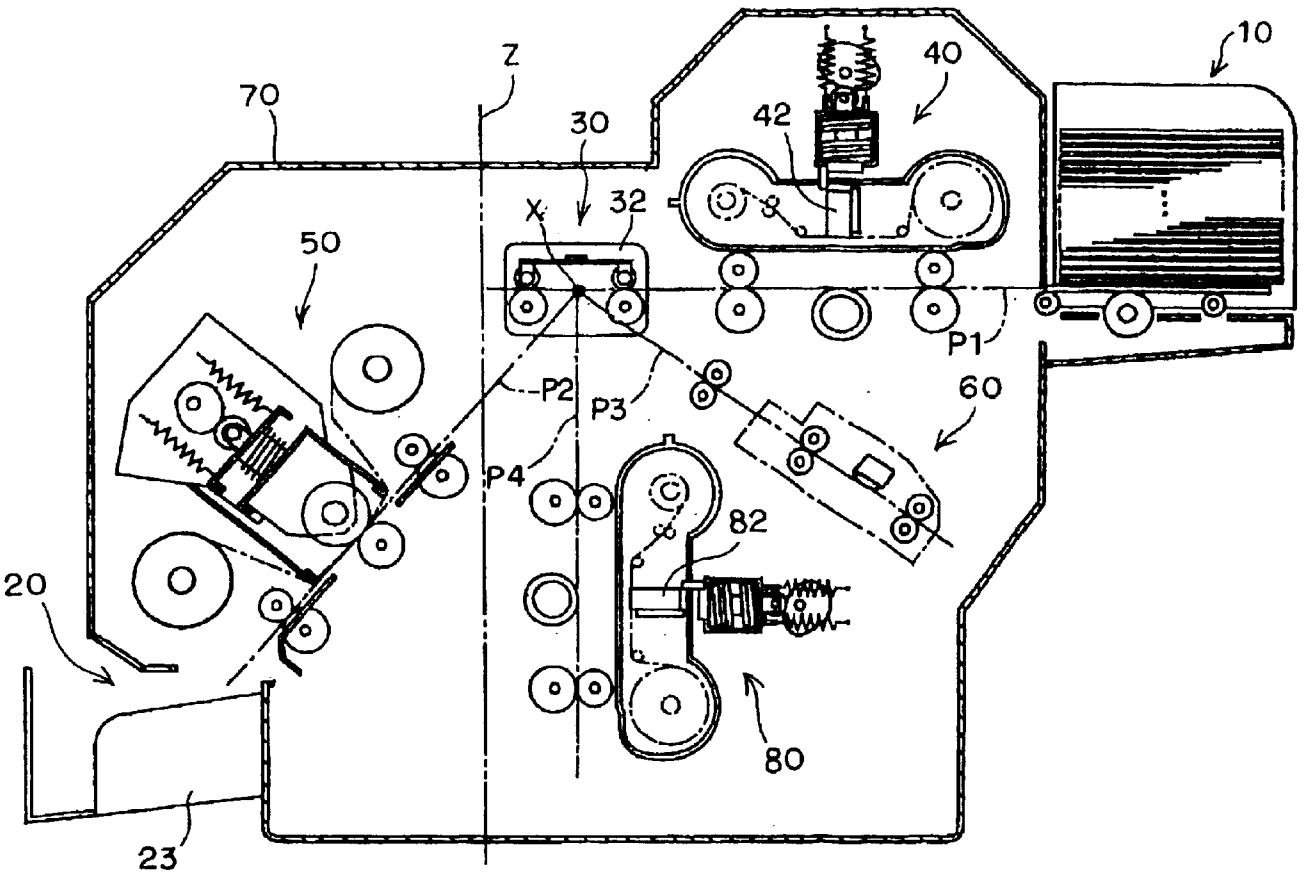
FIG. 13 is a front view schematic drawing of the sixth embodiment of the processing device in accordance with this invention.

In this embodiment, the sixth embodiment of the card processing apparatus of the present invention is illustrated in FIG. 13, but in the same way as with the preceding fifth embodiment, the printer of the first processing unit 40 in the first as illustrated in FIG. 2 or an equivalent printer is added to the fourth processing unit 80 on the fourth transport path p4 arranged directly below the card turning unit 30.

In this structure of this embodiment of the invention, the position for arrangement of the card discharge unit 20 is established at the end of the second transport path whereas it was established at the end of the first transport path p1 in the previous fifth embodiment, which is different. However, the explanation will be omitted because this point has already been covered in the explanations from the first embodiment to the second embodiment. The composing elements are substantially the same as the previous embodiment, thus a detailed explanation shall be omitted.

Furthermore, the drawing and explanation regarding the fifth and sixth embodiments of the invention as illustrated in FIG. 12 and FIG. 13 are explained with the fourth processing unit 80 being a printer, but there is no need to be limited to this. For example, the fourth processing unit 80 and the second processing unit 50 could also both be coating units to over-coat the recording card with the same coating film. In this case, because there are two coating units 50 and 80 to coat with film, it is possible to use two different types of coating film with different colors or patterns, to further expand the applicability and convenience of the card processing apparatus.

Furthermore, in the fifth and sixth embodiments, the first processing unit 40 is used as the printer for convenience, the second processing unit 50 is the coating unit and the third processing unit 60 is the magnetic encoder shown in the figure, although it is not essential that they be limited to these.

Thus, as explained above, the card processing apparatus according to this invention has a second transport path, a third transport path, and yet a fourth transport path that intersect on a point on the first transport path, the intersecting point is provided with a card turning unit that can send cards between each of these transport path, allowing for the efficient transport of cards to each of the processing units established in each of the transport paths to enable the desired process for a rational transport system and the compact arrangements of the apparatus.

Particularly, the card processing apparatus of this invention comprises a card printer and coating film coating unit in the first processing unit and second processing unit, each rationally arranged in the first transport path and the second transport path to allow for compact overall apparatus without decreasing the process of either the card transport efficiency or the printing. Also, by establishing a card turning unit at the intersecting point in the transport path, the recording of all types of information and the coating of coating films can be executed efficiently to the front and the back sides of the card recording medium, and allows for the operation of an easy and stable drive control system.

Further, the recording device of the invention having rational arrangement of the card supply unit for containing blank cards and one or more printer units serving as information recording means allows the second information means such as a magnetic encoder and IC writer, finished-card discharge unit, error-card rejecting unit and other necessary components to be rationally incorporated therein. Also, by incorporating one more unit that allows the linking and separation of the coating unit to over-coat a coating film to the recording card, with regard to the printer unit, this highly versatile card processing apparatus can be applied.

What is claimed is:

1. A card processing apparatus having a substantially horizontally arranged first transport path extended from a card supply unit, a turning unit on said first transport path, a thermal transfer printer that records by thermally transferring information to a card on said first transport path between said card supply unit and said turning unit, a second transport path established at said turning unit and having an angle of 90° or more and less than 180° relative to the first transport path and in a direction away from said thermal transfer printer disposed on said first transport path a coating unit for overcoating coating film on a surface of said card recorded by said thermal transfer printer on said second transport path, and a card discharge unit provided at an end of either said first or said second transport path.

2. The card processing apparatus according to claim 1, wherein said thermal transfer printer and said coating unit are incorporated into one casing.

3. The card processing apparatus according to claim 1, wherein said thermal transfer printer and said coating unit are each incorporated into independent, interlockable casings.

4. The card processing apparatus according to claim 1, wherein said card discharge unit established at the end of said first transport path, said turning unit transports said card to said coating unit, receives said card processed at said coating unit from said coating unit and sends said card to said discharge unit.

5. The card processing apparatus according to claim 1, wherein said card discharge unit established at an end of said second transport path wherein said card processed by said coating unit is sent to said discharge unit along the same direction as the transport of said card to said coating unit from said turning unit.

6. A card processing apparatus provided with a substantially horizontally arranged first transport path extended from a card supply unit, a turning unit established along said first transport path, a second transport path and a third transport path established obliquely at first and second angles, respectively, relative to said first transport path, the first angle different from the second angle, each in a direction away from said turning unit and said first transport path, a card discharge unit provided at an end of at least one of said first, said second and said third transport paths, and first, second and third processing units each established respectively in said first, said second and said third transport paths for performing pre-determined processes on a card.

7. The card processing apparatus according to claim 6, wherein said second transport path is arranged obliquely in a direction away from said first processing unit at said turning unit and said third transport path is arranged obliquely in a direction below said first processing unit at said turning unit.

8. The card processing apparatus according to claim 6, wherein said first processing unit, said second processing unit and said third processing unit are incorporated into one casing.

9. The card processing apparatus according to claim 8, wherein said first processing unit, said second processing unit and said third processing unit are thermal transfer printers comprising thermal heads for thermally transferring thermal transfer ink dispensed by ink ribbons to a card, coating units for overcoatinq coating film on a card surface or magnetic encoders and/or IC writers.

10. The card processing apparatus according to claim 8, wherein said first processing unit, said second processing unit and said third processing unit are thermal printers comprising thermal heads for thermally transferring thermal transfer ink dispensed by ink ribbons to a card, coating units for overcoating coating film on a card surface or magnetic encoders and/or IC writers.

11. The card processing apparatus according to claim 8, wherein said first processing unit, said second processing unit and said third processing unit are encoding or IC writers comprising thermal heads for thermally transferring thermal transfer ink dispensed by ink ribbons to a card, coating units for overcoating coating film on a card surface or magnetic encoders and/or the IC writers.

12. The card processing apparatus according to claim 8, wherein said first processing unit is a thermal printer, said second processing unit is a coating unit and said third processing unit is an encoding or IC writer comprising thermal heads for thermally transferring thermal transfer ink dispensed by ink ribbons to a card and the coating unit overcoating coating film on a card surface or magnetic encoders and/or the IC writers.

13. The card processing apparatus according to claim 6, wherein at least one of said first processing unit, said second processing unit or said third processing unit is incorporated into a casing that is separate and independent from other said processing units and is interlockable to casing storing other said processing units.

* * * * *